United States Patent [19]

Sieber

[11] Patent Number: 4,566,414

[45] Date of Patent: Jan. 28, 1986

[54] CONTROL SYSTEM FOR AN INTERNAL COMBUSTION ENGINE

[75] Inventor: Albrecht Sieber, Böblingen, Fed. Rep. of Germany

[73] Assignee: Robert Bosch GmbH, Stuttgart, Fed. Rep. of Germany

[21] Appl. No.: 662,534

[22] Filed: Oct. 18, 1984

Related U.S. Application Data

[63] Continuation of Ser. No. 366,272, Apr. 7, 1982, abandoned.

[30] Foreign Application Priority Data

Apr. 11, 1981 [DE] Fed. Rep. of Germany ..... 3114836

[51] Int. Cl.[4] ..... F02M 39/00

[52] U.S. Cl. ..... 123/357; 123/365; 123/359

[58] Field of Search ..... 123/357, 358, 359, 365, 123/325

[56] References Cited

U.S. PATENT DOCUMENTS

| | | | |
|---|---|---|---|
| 3,643,635 | 2/1972 | Milam | 123/357 |
| 4,337,839 | 7/1982 | Taplin | 123/357 |
| 4,346,688 | 8/1982 | Kaibara | 123/357 |
| 4,357,920 | 11/1982 | Stumpp | 123/358 |
| 4,368,705 | 1/1983 | Stevenson | 123/357 |

*Primary Examiner*—Carl Stuart Miller

*Attorney, Agent, or Firm*—Edwin E. Greigg

[57] ABSTRACT

A control system for an internal combustion engine which has a driving-pedal position transducer, a subsequent performance graph apparatus for control values and a control device responding to these values. A delay element is provided in series with the performance graft apparatus between the driving-pedal position transducer and the control device. The purpose of the control system is to adapt the mode of response of the control device (a throttle valve, for instance, in an Otto engine or the regulator rod in a Diesel engine) to various operational states. Of special significance are rpm, the position of the driving pedal, and the change in driving-pedal position. The proposed system is efficaciously realized by means of a computer.

14 Claims, 9 Drawing Figures

2 ↑ 4
2 ↓ 3
33

10
32
37
38
Δα
α
α
RPM METER
n
35
36
34
SIGNAL GENERATOR n - no
7.1

7.2
YES
Δn >0
NO
7.3
5
7.5
7.4
4
7.6

8.1
(4.1)
8.2
YES
NO
> 0
?
8.3
K2
8.5
K1
8.6
8.4
8.7

CONTROL SYSTEM FOR AN INTERNAL COMBUSTION ENGINE

This is a continuation of copending application Ser. No. 366,272 filed Apr. 7, 1982 now abandoned.

BACKGROUND OF THE INVENTION

The invention relates generally to control systems for internal combustion engines, and, more particularly, to a control system including a driving pedal transducer for generating a pedal position signal, a performance graph apparatus for generating a control signal in accordance with at least the pedal position signal, and an engine control device actuated in accordance with the control signal.

In vehicles of all kinds, a high degree of driving comfort is being paid a great deal of attention at the present time. On the other hand, increasingly stringent legal regulations relating to internal combustion engine exhaust emissions must also be taken into consideration. This has led to the increasing use of electronic components and computers in open-and closed-loop engine control. The same applies both to the control of the throttle valve in an Otto engine and the control of the regulator rod in a Diesel engine, in either case in accordance with the position of the driving pedal. Ascertaining the position of the driving pedal by means of a driving-pedal transducer and reading out a corresponding position signal, for instance for the throttle valve, from a performance graph are known.

It has now been demonstrated that this known apparatus is not always capable of providing satisfactory results, especially with a view to smooth and quiet driving in transitional states such as during acceleration or deceleration.

SUMMARY OF THE INVENTION

The control system for an internal combustion engine described herein is similar to known control systems in that it includes: (1) a driving-pedal position transducer for generating a pedal position signal; (2) a subsequent performance graph apparatus for generating a control signal in accordance with the pedal position signal; and (3) an engine control device which is actuated in accordance with the control signal.

However, the control system according to the invention also includes at least one signal delay circuit for delaying or filtering a signal supplied to it, and at least one associated bypass switch, which is controlled in accordance with an engine operating parameter, for either connecting the delay circuit in series with the performance graph apparatus between the driving-pedal position transducer and the control device or by-passing the delay circuit so that the performance graph apparatus is still connected between the driving-pedal position transducer and the control device.

In a preferred embodiment, the control system includes two signal delay circuits associated respectively with two bypass switches which are controlled in accordance with the driving-pedal position and with the variation, or change with respect to time, of the driving-pedal position, respectively. The two signal delay circuits may also be bypassed or connected in the circuit by a third bypass switch which is controlled in accordance with engine speed.

Typically, the performance graph apparatus generates the control signal in accordance with at least another engine parameter, such as engine speed, as well as in accordance with the pedal position signal.

The control system according to the invention has the advantage over the prior art that optimal driving is assured in all operational states which may arise, and appropriate attention is simultaneously paid to producing a clean exhaust.

The invention will be better understood and further objects and advantages thereof will become more apparent from the ensuing detailed description of preferred embodiments taken in conjunction with the drawings.

DESCRIPTION OF THE EXEMPLARY EMBODIMENTS

Figure 1:
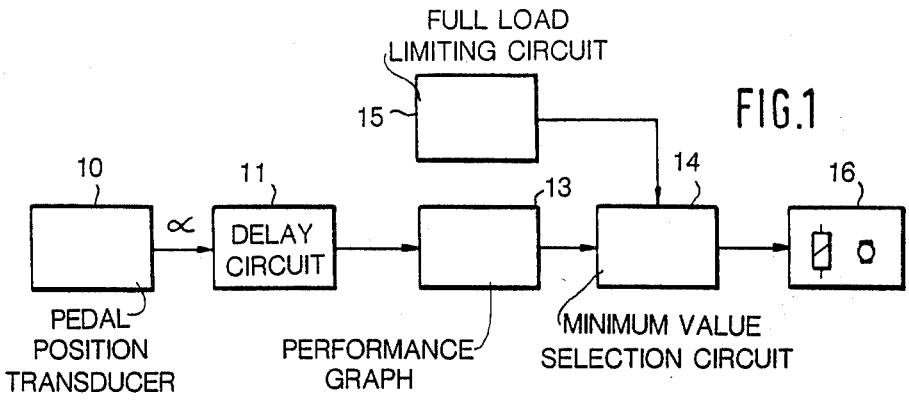
FIG. 1 is a block circuit diagram of the triggering circuit for a regulator rod of a Diesel engine which determines the injection quantity.

FIG. 1, in the form of a block circuit diagram, shows the most essential elements in the trigger circuit for the regulator rod of a Diesel injection pump. However, the actual engine type is of no significance in terms of the invention, because the invention relates to the electronics subsequent to the driving pedal. The driving pedal and an associated driving-pedal position transducer are indicated by reference numeral 10. The driving-pedal delay circuit 11 will be referred to below simply as a delay or filter circuit. A performance graph 13 follows, as well as a minimum-value selection circuit 14, to which the output signal of a full-load limiting circuit 15 can additionally be delivered. The output signal of the minimum-value selection circuit 14 finally reaches an electromagnetic final control element or servomotor 16 for setting the regulator rod of the injection pump for the Diesel engine.

The fundamental apparatus shown in FIG. 1 is known. The invention relates to the functioning of block 11, that is, the driving-pedal delay circuit, and to its realization.

It has proved to be efficacious to dispose the block 11 so that it precedes the performance graph 13. However, under specialized conditions, it may be advantageous for the performance graph 13 to be disposed directly following the driving pedal and its driving-pedal position transducer 10.

Figure 2:
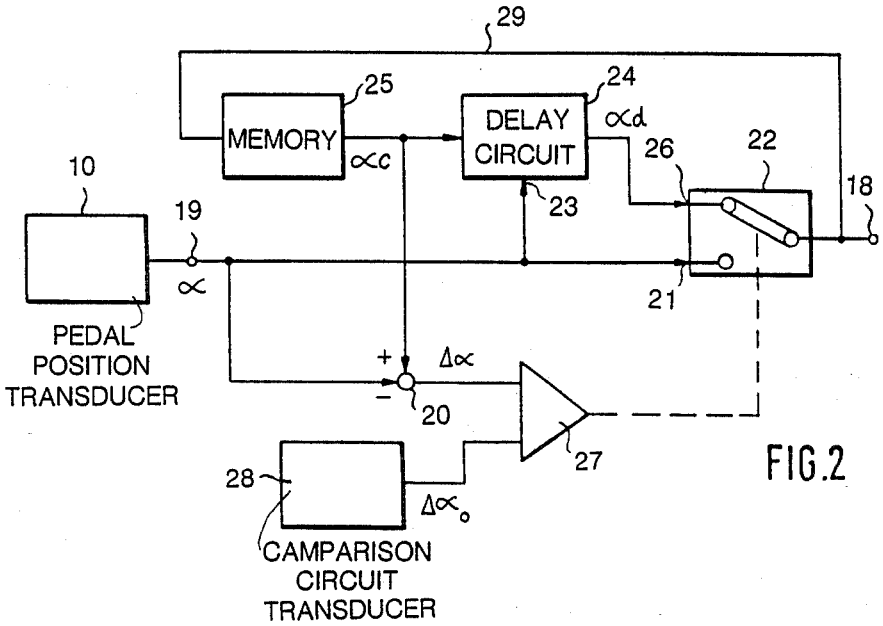
FIGS. 2 and 3 are two block circuit diagrams of driving-pedal delay circuits for small-and large-signal modes of operation, respectively.

FIG. 2 shows a first version of a driving-pedal delay circuit apparatus 11, which functions in accordance with the variation $\Delta\alpha$ in the driving-pedal signal $\alpha$. Depending on the driving-pedal variation $\Delta\alpha$, either the direct value $\alpha$ or a delayed value $\alpha_d$ is switched through to an output 18 of the apparatus.

The output signal $\alpha$ from the driving-pedal position transducer 10 reaches an input terminal 19, from which lines lead to a subtraction point 20, a first input 21 of an alternation switch 22 and an input 23 of a delay element 24. A memory 25 serves to provide comparison values $\alpha_c$ as successive input signals for the subtraction point 20 and as control signals for the delay element 24. The output of this delay element 24 is connected with a second input 26 of the alternation switch 22, whose switch position is determined by the output signal of a comparator 27. Input signals of the comparator 27 are, first, the output signal $\Delta\alpha$ of the subtraction point 20 and, finally, an absolute value $\Delta\alpha_o$ from a comparison-signal transducer 28. A line 29 from the output 18 of the alternation switch 22 also serves to supply the memory 25 with the comparison values $\alpha_c$ successively stored therein.

The basic concept of the circuit layout of FIG. 2 is to switch the output signal $\alpha$ of the driving pedal position transducer 10 directly through to the subsequent performance graph 13 at predetermined operating conditions, but at specialized operating states to cause the delay element 24 to function. One specialized operating state, in the case of the subject of FIG. 2, is the process of acceleration, in which values which are picked up in succession are less than a predetermined difference. At that time, the comparator 27 switches over and allows the delay element 24 to become effective by switching the output signal $\alpha_d$ of this delay element 24 through to the output 18 of the circuit layout.

Figure 4:
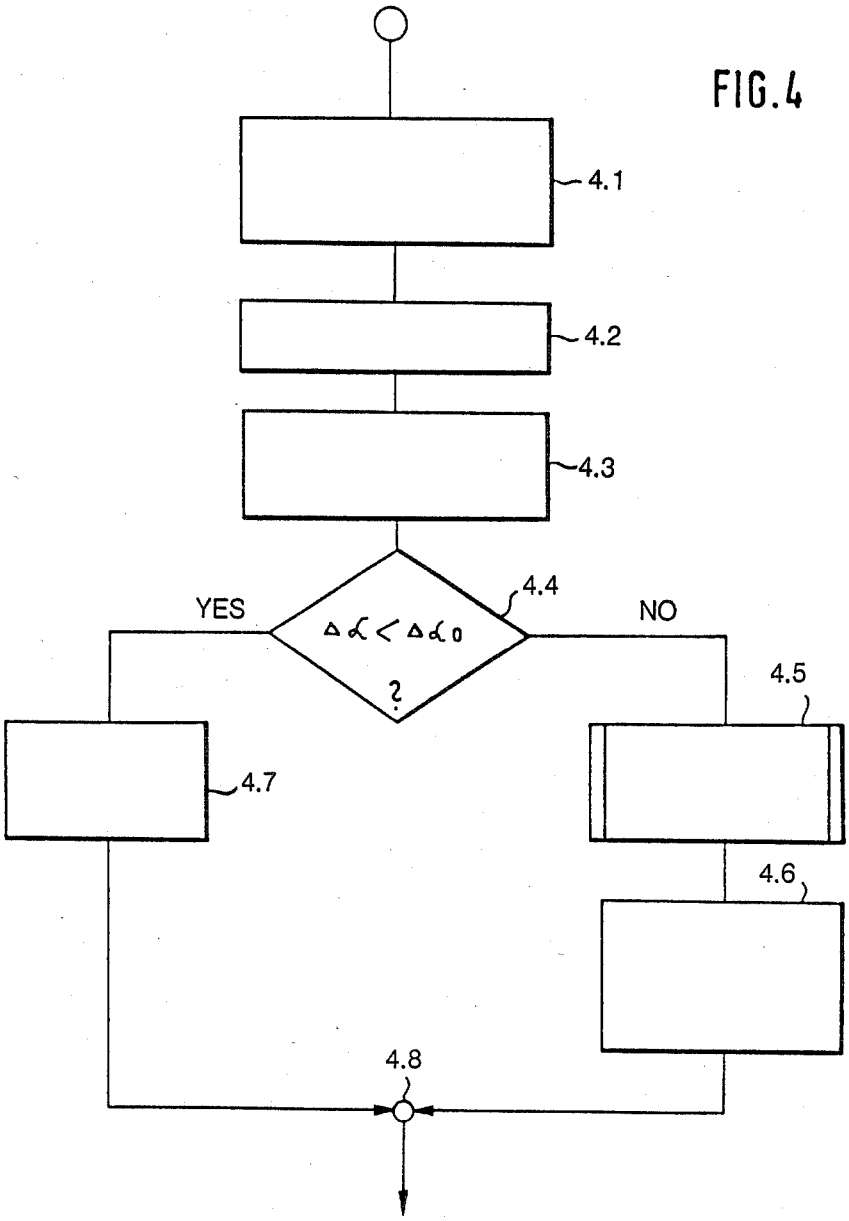
FIG. 4 is a flow diagram for the mode of operation of the circuit of FIG. 2.

In detail, the result is the following signal mode, which is shown in FIG. 4. The individual blocks in the flow diagram of FIG. 4 are numbered in sequence, and the first digit of each numeral refers to the drawing figure itself.

In block 4.1, the difference is formed between the value $\alpha$ of the driving-pedal position transducer and the comparison valve $\alpha_c$ of the memory 25. This corresponds to the formation of a signal relating to the driving-pedal variation, irrespective of its direction--that is, of whether acceleration or deceleration is taking place. In the next block 4.2, the magnitude of the driving-pedal variation $\Delta\alpha$ is determined and, finally, in block 4.3 the difference between the amount of the driving-pedal variation $\Delta\alpha$ and a comparison value $\Delta\alpha_o$ is formed. The next step is the interrogation 4.4 as to whether the driving-pedal variation $\Delta\alpha$ is less than this predetermined value $\Delta\alpha_o$ or not. If the variation $\Delta\alpha$ is greater, then the block 4.7 becomes operative and assures that the driving-pedal value is switched through to the output 18 of the circuit layout of FIG. 2. If the driving-pedal variation $\Delta\alpha$ is less than the predetermined value $\Delta\alpha_o$, however, then the alternation switch 22 remains in the illustrated position, and a subprogram 4.5 is run in a computer which is the basis of the entire apparatus; the delay element 24 of FIG. 2 functions in accordance with this subprogram. This subprogram is shown in detail in FIG. 8 and will be discussed in further detail below. In the illustrated position of the switch 22, the output signal of the delay element 24 reaches the output 18 in accordance with block 4.6, and the program loop attains its terminus at block 4.8.

A comparison of FIGS. 2 and 4 clearly shows that even a computer-controlled realization of the subject of FIG. 2 is unproblematic for one skilled in the appropriate art. The same applies in the reverse instance, that is, if one skilled in the art is supposed to produce a discrete circuit for the block diagram of FIG. 2 on the basis of the flow diagram of FIG. 4.

Figure 3:
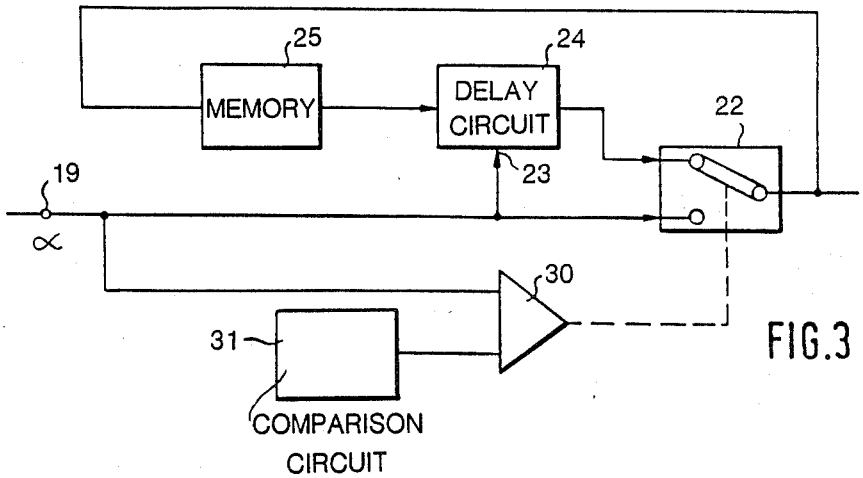

In the subject of FIG. 2, the alternation switch 22 is switched in accordance with the driving-pedal variation $\Delta\alpha$. In the subject of FIG. 3, a change is provided with a view to actuating this alternation switch in accordance with the absolute value $\alpha$ for the driving-pedal position. To this end, the input signal from the input 19 is switched directly to a comparator 30, at the second input of which a corresponding threshold value $\alpha_t$ is present. A value of, for example, 30% of the maximum possible driving-pedal path may be selected for this threshold value $\alpha_t$. The threshold is made available in a comparison circuit 31. In other respects, there is the same design as in the circuit layout of FIG. 2.

Figure 5:
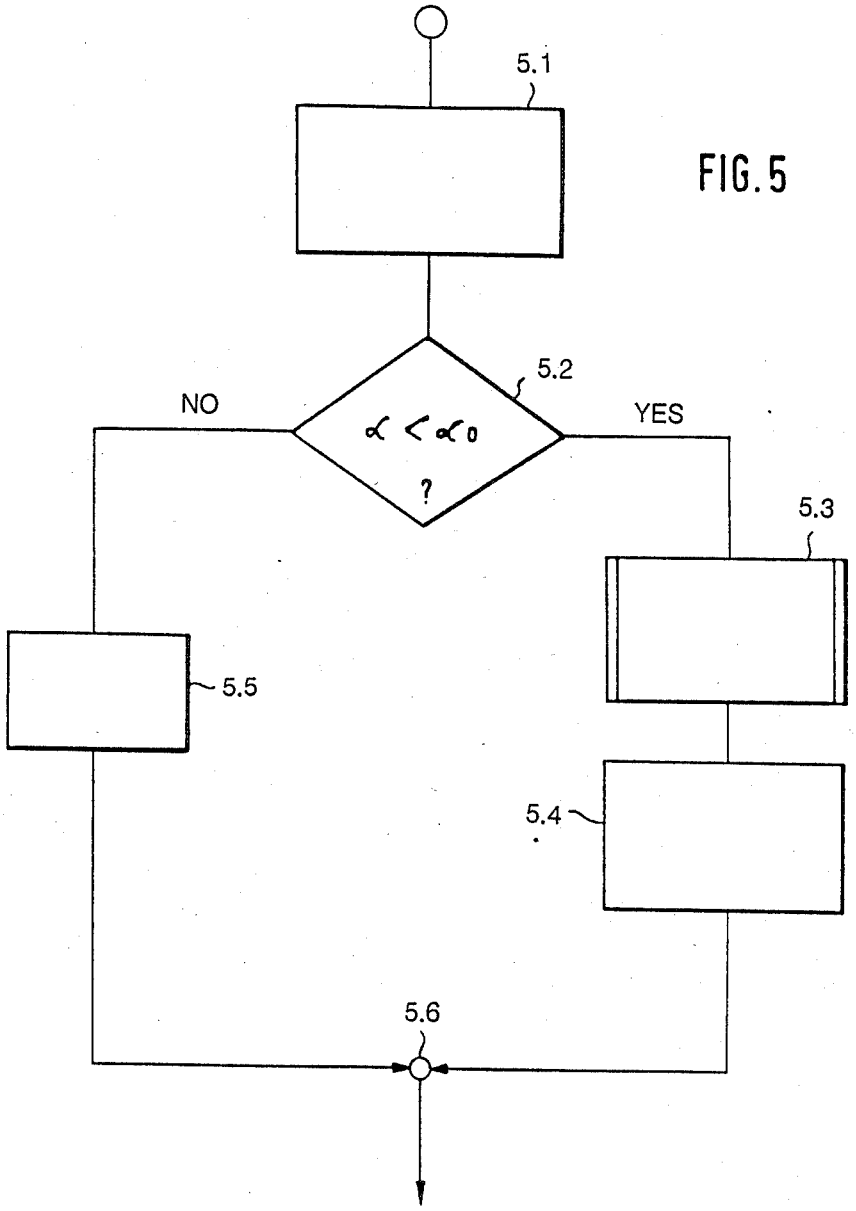
FIG. 5 is a flow diagram for the mode of operation of the circuit of FIG. 3.

FIG. 5 shows the mode of operation of the apparatus of FIG. 3. In block 5.1, the difference between the driving-pedal value $\alpha$ and the driving-pedal threshold value $\alpha_t$ is formed, and an interrogation as to magnitude is performed in block 5.2. If the driving-pedal value $\alpha$ is below the driving-pedal threshold $\alpha_t$, then again a program is run in accordance with block 5.3, and the delayed driving-pedal value $\alpha_d$ is placed in block 5.4 in the memory 25 and is available for further processing. In the other case, that is, if the driving-pedal value $\alpha$ is greater than the driving-pedal threshold $\alpha_t$, then the driving-pedal value $\alpha$ is placed in the memory 25 directly in accordance with block 5.5.

The purpose of these two modes of operation is to permit changes in driving-pedal position, such as result from the driver's desire for acceleration or full-load operation, to be fully effective, but for any minor fluctuations or quivering in the form of a lesser actuation of the driving-pedal to be suppressed.

Figure 6:
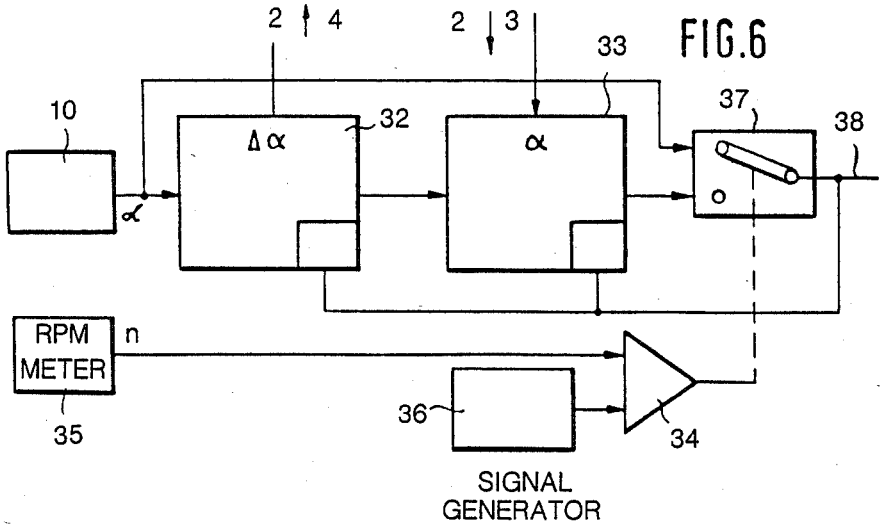
FIG. 6 is a block circuit diagram of a combination of the circuits of FIGS. 2 and 3.

It has proved to be efficacious for the two circuit layouts of FIGS. 2 and 3, or the signal processing shown in FIGS. 4 and 5, to be combined and then expanded by adding an rpm dependency. A corresponding block circuit diagram is shown in FIG. 6. Block 32 represents the circuit layout of FIG. 2—that is, the driving-pedal delay dependent on the change in driving-pedal position—and block 33 represents the circuit layout of FIG. 3 for a delay dependent on driving-pedal position. The individual memories 25 as shown in FIGS. 2 and 3 as well as the other circuit elements shown there are all integrated into the two blocks 32 and 33, respectively. In addition to this, the rpm dependency is provided by way of a comparator 34 for an actual rpm value drawn from an rpm meter 35 and an rpm threshold value drawn from a corresponding signal generator circuit 36. On the output side, the comparator 34 is connected with an alternation switch 37, which switches the signal from the driving pedal position transducer 10 first directly to an output 38 of the layout and secondly via the two blocks 32 and 33.

Figure 7:
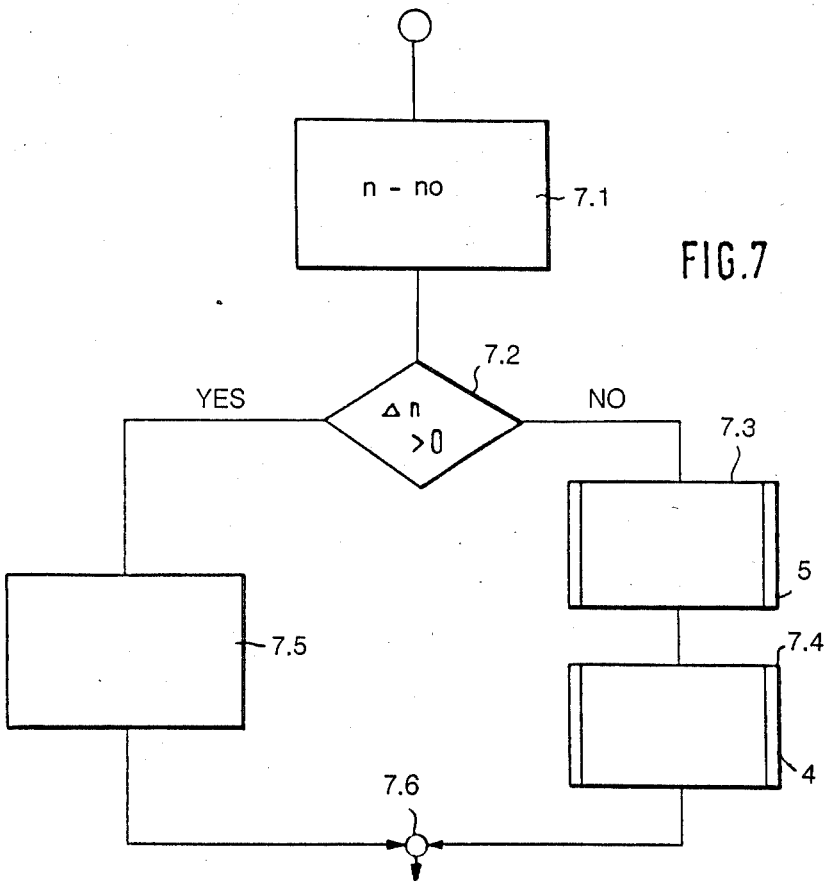
FIG. 7 is a flow diagram for the functioning of the circuit of FIG. 6.

The mode of operation of the layout shown in FIG. 6 is shown in simplified schematic form in FIG. 7, wherein the primary distinguishing criterion, the rpm, is processed as a signal. Block 7.1 represents the subtraction circuit for the actual rpm value n and the rpm threshold value $n_T$. If the rpm is below the threshold, then the branch extending toward the right, beginning at block 7.2, comes into action, and then the subprograms for the individual delays corresponding to block 5.3 of FIG. 5 and block 4.5 of FIG. 4 come into effect as well. Block 7.3 in this instance represents the subprogram for the large-signal mode—that is, the delay dependent on the actual position of the driving pedal—while 7.4 is the subprogram for the small-signal mode dependent on the change in driving-pedal position. These two subprograms 7.3 and 7.4 are run one after another as shown in FIG. 7. For the case where the measured rpm is above the rpm threshold, the program runs its course through the left-hand loop of the flow diagram, and in accordance with 7.5 the measured driving-pedal value is stored in the respective memories. The terminus again is the collective point 7.6 of the two branches of the flow diagram.

The rpm interrogation provided in FIG. 7 is effected on the basis that no delay in the course of the change in the driving pedal should occur above a predetermined rpm, since at high rpm priority is given to the driver's actual intention.

Figure 8:
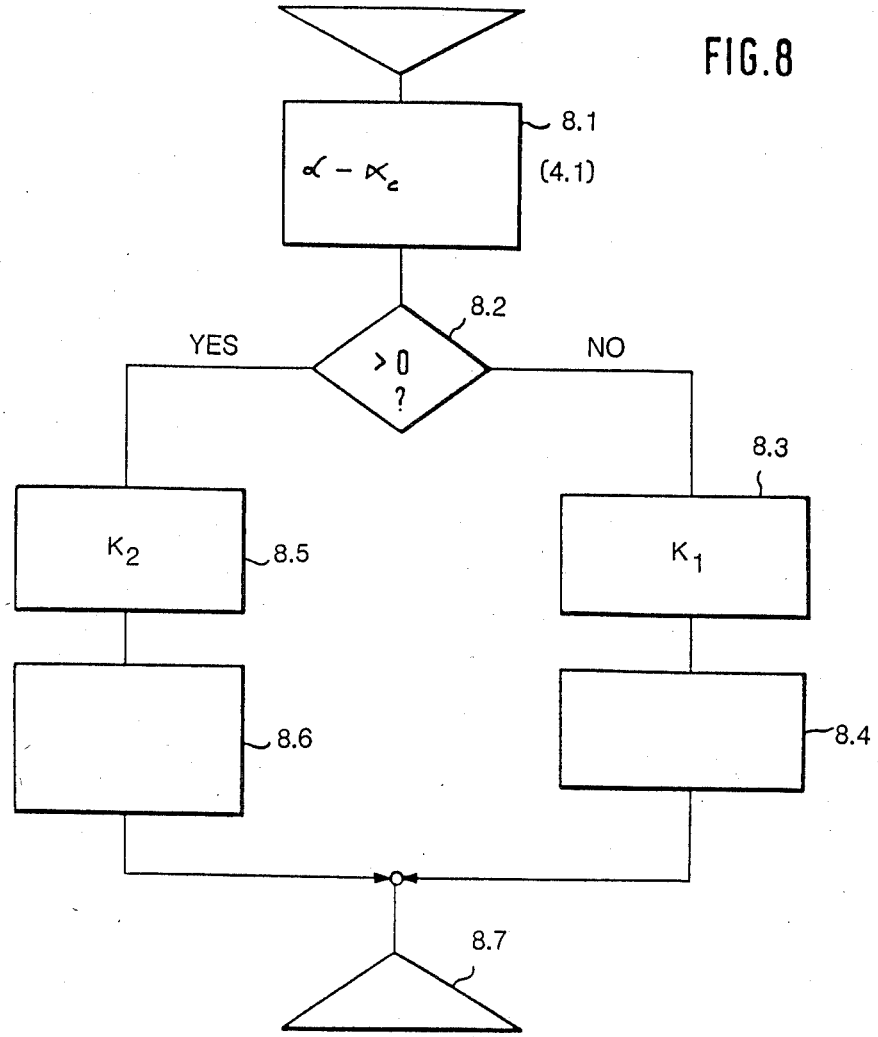
FIG. 8 is a flow diagram showing the treatment of the specialized operating conditions represented by acceleration and deceleration; and, FIG. 9 illustrates the complete course of the program in the form of a flow diagram.

FIG. 8, in the form of a flow diagram, shows a subprogram for limiting the variation. According to this, the difference between the measured driving pedal position $\alpha$ and the stored driving-pedal value $\alpha_c$ is formed in block 8.1. If this difference is less than 0, then deceleration is occurring, and the right-hand branch of the flow diagram of FIG. 8 becomes effective with the entry of a constant 1 for the delay corresponding to block 8.3 and the subsequent subtraction of this constant $K_1$ from the value in the driving-pedal memory according to block 8.4. In the other case, that is, in acceleration, the constant $K_2$ is entered, and an addition of this constant $K \equiv K2$ to the driving-pedal value stored in memory takes place in block 8.6. Following the subtraction in block 8.4 and the addition in block 8.6, this subprogram is terminated, and a return to the primary program is made (8.7).

In terms of selecting the constants $K_1$ and $K_2$ for deceleration and acceleration, the specialized conditions of a particular engine or of a vehicle equipped with such an engine must be taken into consideration. These constant values $K_1$ and $K_2$ may then be the same or different. The subprogram of FIG. 8 is included in blocks 4.5 of FIG. 4 and 5.3 of FIG. 5.

Figure 9:
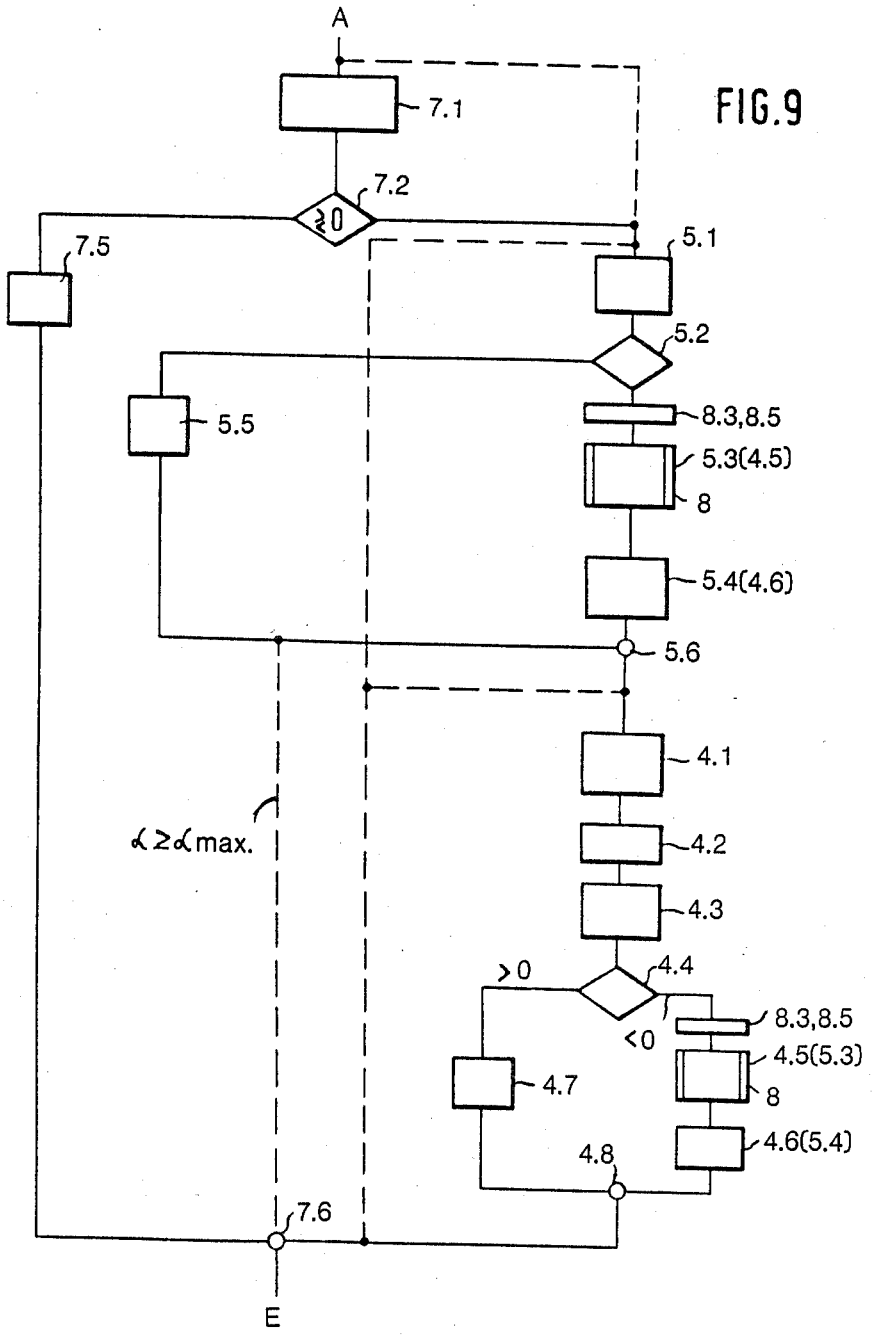

FIG. 9, in the form of a flow diagram, illustrates the totality of the features provided for delaying or filtering the change in output signal at specific driving-pedal positions and at specific variations in such positions. The same numbering system is used in FIG. 9 as in the flow diagrams of FIGS. 4, 5, 6, 7 and 8. The sequential course over time of the individual interrogations as to rpm, absolute driving-pedal position and variation in driving-pedal position can be seen from the diagram. As described individually, various "bypass branches" are provided for specialized operating states such as high rpm, sharply depressed driving pedal, and large variation in driving-pedal position.

The broken lines shown in FIG. 9 symbolize the possibility of leaving some signal processes out of consideration. The particular combination of signal processes which is finally selected is a matter of the expenditure justified in a particular instance and the stringency with which a specific desired driving mode is required. However, the totality of possibilities illustrated and discussed herein represents an optimal driving mode which taking into consideration aspects of particular importance at the present time.

The foregoing relates to preferred exemplary embodiments of the invention, it being understood that other embodiments and variants thereof are possible within the spirit and scope of the invention, the latter being defined by the appended claims.

What is claimed and desired to be secured by letters patent of the United States is:

1. A control system for controlling fuel quantity in an internal combustion engine, comprising:

a driving-pedal position transducer for generating a pedal position signal indicating the position of an engine driving pedal;

a performance graph means, connected to receive said pedal position signal, for generating a control signal in accordance with said pedal position signal;

an engine control device, connected to receive said control signal, for controlling an operation of said engine in accordance with said control signal;

at least one signal delay circuit means for delaying a signal supplied thereto;

said at least one signal delay circuit means being dependent on one output signal of at least one switching means and being controlled thereby in accordance with a selected engine operating parameter for either (1) connecting in series said signal delay circuit means in a series circuit between said driving-pedal position transducer and said performance graph means, or (2) disconnecting said delay circuit means from said series circuit.

2. In a control system for controlling fuel quantity in an internal combustion engine comprising:

a driving-pedal position transducer for generating pedal position values indicating the position of an engine driving pedal, a performance graph means, connected to receive said pedal position values, for generating control values in accordance with said pedal position values, and an engine control device, connected to receive said control values, for controlling an operation of said engine in accordance with said control values, the improvement which comprises:

delay means connected to said driving-pedal position transducer for delaying said pedal position values in accordance with at least one operating parameter of said engine, and a switching means responsive to engine rpm during special operating states of said engine for connecting said delay means to said performance graph means and disconnecting said driving-pedal position transducer from a direct circuit with said performance graph means.

3. In a control system for controlling fuel quantity in an internal combustion engine comprising:

a driving-pedal position transducer for generating pedal position values indicating the position of an engine driving pedal, a performance graph means, connected to receive said pedal position values, for generating control values in accordance with said pedal position values, and an engine control device, connected to receive said control values, for controlling an operation of said engine in accordance with said control values, the improvement which comprises:

delay means connected to said driving-pedal position transducer for delaying said pedal position values in accordance with at least one operating parameter of said engine, and a switching means responsive to the driving-pedal position during special operating states of said engine for connecting said delay means to said performance graph means and disconnecting said driving-pedal position transducer from a direct circuit with said performance graph means.

4. A control system as defined by claim 3, wherein said switching means responsive to the driving pedal position is further responsive to the variation in driving-pedal position.

5. A control system as defined by claim 2, wherein said switching means responsive to the engine rpm is further responsive to driving-pedal position and driving-pedal position variation.

6. A control system as defined by claim 2, characterized in that said delay means comprises value increase limiting means for limiting increases in said control values.

7. A control system as defined by claim 2, characterized in that said delay means comprises value decrease limiting means for limiting reductions in said control values.

8. A control system as defined by claim 2, further comprising computer means for controlling said switching means for connecting said delay means.

9. A control system according to claim 2, wherein said special operating states comprise at least one of acceleration, deceleration and high rpm.

10. A control system according to claim 3, wherein said special operating states comprise at least one of acceleration, deceleration and high rpm.

11. A control system as defined by claim 3, characterized in that said delay element comprises value increase limiting means for limiting increases in said control values.

12. A control system as defined by claim 3, characterized in that said delay element comprises value decrease limiting means for limiting reductions in said control values.

13. A control system as defined by claim 3, further comprising computer switching means for controlling said means for connecting said delay means.

14. A control system according to claim 1, further comprising a computer means for controlling said switching means.

* * * * *